United States Patent [19]

Yukawa et al.

[11] Patent Number: 4,800,359

[45] Date of Patent: Jan. 24, 1989

[54] WINDING OF NOISE SUPPRESSING HIGH TENSION RESISTIVE ELECTRICAL WIRE

[75] Inventors: Yoshimi Yukawa; Seiichi Wakabayashi, both of Shizuoka, Japan

[73] Assignee: Yazaki Corporation, Tokyo, Japan

[21] Appl. No.: 137,699

[22] Filed: Dec. 24, 1987

[51] Int. Cl.[4] ..... H01C 3/06

[52] U.S. Cl. ..... 338/214; 338/264; 338/270

[58] Field of Search ..... 338/66, 214, 264, 270

[56] References Cited

U.S. PATENT DOCUMENTS

| | | | |
|---|---|---|---|
| 3,284,751 | 11/1966 | Barker et al. | 338/214 X |
| 3,518,606 | 6/1970 | Barker | 338/214 X |
| 3,683,309 | 8/1972 | Hirose | 338/214 |
| 4,748,436 | 5/1988 | Kanamori et al. | 338/214 |

FOREIGN PATENT DOCUMENTS

| | | |
|---|---|---|
| 247401 | 3/1925 | United Kingdom . |
| 0184954 | 11/1985 | European Pat. Off. . |
| 565228 | 5/1943 | United Kingdom . |
| 939611 | 10/1959 | United Kingdom . |
| 1109008 | 7/1965 | United Kingdom . |
| 1121375 | 1/1967 | United Kingdom . |
| 1335580 | 1/1971 | United Kingdom . |
| 2033645 | 9/1979 | United Kingdom . |

*Primary Examiner*—C. L. Albritton

*Attorney, Agent, or Firm*—Sughrue, Mion, Zinn, Macpeak & Seas

[57] ABSTRACT

A winding of noise suppressing high tension resistive electrical wire is disclosed which comprises a reinforcing fiber cord bound by immersion in a low-viscosity liquid resin binder, an elastomeric coating layer formed on a surface of the fiber cord by application of a liquid rubber paint, a metallic resistive wire wound around the coating layer, and an insulating protective layer. The outer diameter of the winding may be less than about 7 mm.

8 Claims, 1 Drawing Sheet

WINDING OF NOISE SUPPRESSING HIGH TENSION RESISTIVE ELECTRICAL WIRE

BACKGROUND OF THE INVENTION

The present invention relates to an ignition cable for use in motor vehicles such as automobiles.

Noise suppressing high tension resistive electrical wires comprising reinforcing cords about which metallic resistive wires are wound and subsequently provided with insulation coatings have been used as ignition cables in automobiles.

A conventional type of such high tension electrical wires has the composition shown in FIG. 2. A reinforcing cord 5a formed of a bundle of fine, high-strength fibers such as glass fibers or Aramid fibers is provided with an extruded coating layer 5b of such a material as a ferrite powder filled silicone rubber. A fine metallic resistive wire 5c made of a Ni-Cr alloy or the like is wound around the coating 5b to form a conductor winding 5. This conductor 5 is wrapped with an insulating rubber coating layer 6, a glass fiber braid 7 and a sheath 8 to form a high tension resistive electrical wire. A ignition cable is fabricated by installing a metallic terminal on both ends of the resistive wire.

The high tension resistive electrical wire employing a conductor winding of the type described above ensures consistent performance but has the disadvantage of increased thickness.

Car manufacturers are making active efforts to furnish their products with an increasing number of capabilities in engine rooms and as the density of components installed in the engine room increases, it becomes more and more difficult to harness the wiring of ignition cables over the shortest distance. However, the conventional noise suppressing high tension resistive electrical wires which are thick and difficult to bend involve considerable difficulty in harnessing the cables in small spaces. It has therefore been desired to develop a noise suppressing high tension resistive electrical wire that is finer and which can be bent at a smaller radius of curvature.

SUMMARY OF THE INVENTION

An object, therefore, of the present invention is to provide a noise suppressing high tension resistive electrical wire that can be harnessed in a small space and which yet ensures a performance comparable to that attained by the conventional products.

The above-stated object of the present invention can be attained by a high tension resistive electrical wire that employs a winding of conductor which is fine, supple and capable of withstanding cyclic bending operations without performance deterioration. The winding of noise suppressing high tension resistive electrical wire according to the present invention comprises a reinforcing fiber cord bound by immersion in a low-viscosity liquid resin binder, an elastomeric coating layer formed on the surface of said fiber cord by application of a liquid rubber paint, a metallic resistive wire wound in such a way that it is embedded in said coating layer, and an insulating protective coating including a fiber braid. This wire preferably has an outside diameter of not more than 7 mm.

The conductor winding in the noise suppressing high-voltage resistive electrical wire of the present invention is reinforced with a plurality of long fibers having high strength and heat resistance such as glass fibers or Aramid fibers that are stranded at given pitches.

In order to ensure utmost binding, the monofilaments in the reinforcing fiber bundle are immersed in a liquid resin binder. The resin binder used for this purpose is required to be such that it have the lowest possible viscosity to achieve thorough impregnation in the fiber bundle as a result of dipping and that it harden upon drying to exhibit a strong bond. Examples of the resin binder that satisfies these requirements include solutions or dispersions of thermosetting resins such as phenolic resins and epoxy resins, and solutions or dispersions of thermally crosslinking acrylic resins or styrene-butadiene resins.

The fiber bundle immersed in the resin binder illustrated above is subsequently dried and heat-treated, as required, to form a reinforcing fiber cord. Before a metallic resistive wire is wound around this fiber bundle, it must be provided with an elastomeric coating layer. The elastomeric coating layer is required to have sufficient degrees of heat resistance and mechanical strength. Such a coating can be formed of any conventional material like silicone rubber or ethylene-propylene rubber. These materials may be mixed with optional components such as crosslinking agents, antioxidants, softening agents, fillers or conductivity imparting agents. If desired, the mixtures may be dispersed in suitable solvents to form liquid paints.

If the thickness of the elastomeric coating layer is smaller than the diameter of the metallic resistive wire to be wound around it, turns cannot be formed at constant pitches and the resulting winding will not have stable resistivity. If the elastomeric coating layer is thicker than the diameter of the metallic resistive wire, a fine and pliant high tension resistive electrical wire that meets the object of the present invention cannot be attained. Therefore, the elastomeric coating layer desirably has a thickness in the range of from about 0.02 to 0.04 mm. In order to form a coating having this thickness, the aforementioned liquid rubber paint, after being adjusted to a reasonably low viscosity, is applied to give a desired thickness by an appropriate method such as dipping. If the desired thickness of coating is not produced by a single application, two or more coatings are applied until the proper thickness is attained.

The metallic resistive wire that is to be wound on the elastomeric coating layer overlying the reinforcing fiber cord may be formed of any known material such as nickel or Nichrome, with a wire diameter typically ranging from 0.035 to 0.065 mm. The metallic resistive wire must be wound in such a way that it is sufficiently embedded in the elastomeric coating layer to prevent adjacent turns from contacting each other.

The resulting conductor winding is subsequently coated with an insulator layer made of a heat-resistant and oxidation-resistant rubber material such as EPDM. If desired, it may be further wrapped with a braid of fibers such as glass fibers and extrusion-coated with a protective material such as EPDM or silicone rubber. These steps complete the procedures for the fabrication of a winding of noise suppressing high tension resistive electrical wire according to the present invention.

DESCRIPTION OF THE PREFERRED EMBODIMENTS

The so fabricated winding of noise suppressing high voltage resistive electrical wire of the present invention is fine and supple and will not experience any substantial variations in resistance upon repeated bending.

EXAMPLE

Figure 1:
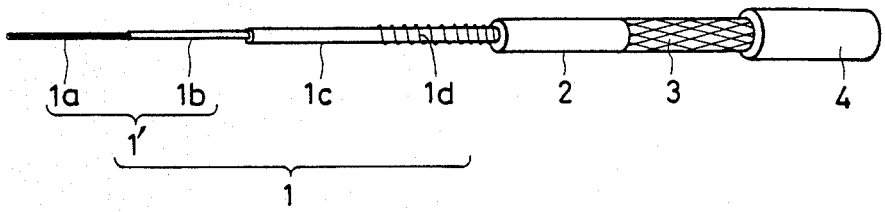
FIG. 1 is a perspective view showing the structure of a winding of noise suppressing high tension resistive electrical wire according to one embodiment of the present invention.
Figure 2:
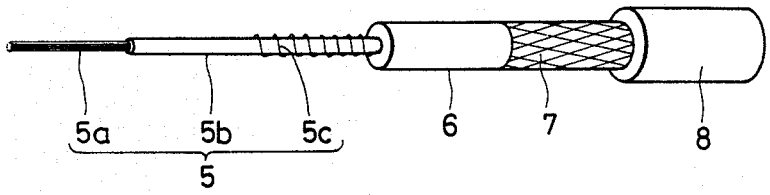
FIG. 2 PRIOR ART
FIG. 2 is a perspective view showing the structure of a winding of noise suppressing high tension resistive electrical wire produced by a prior art method.

An example of the present invention is hereinafter described with reference to FIG. 1.

A bundle of reinforcing fibers 1*a* was made by stranding three 1,000 d filaments of a wholly aromatic polyamide fiber (Kevlar® of Dupont). The fiber bundle was impregnated with a resin binder 1*b* by immersion in a bath of an acrylic emulsion (ALMATEX® XV-E-3371 of Mitsui Toatsu Chemicals, Inc.). By subsequent drying, a reinforcing fiber bundle 1' was made.

A rubber paint was prepared by dissolving an electrical conductive composition in toluene at a concentration of 25%. The composition contained 83.5% of an addition reactive silicone rubber (DY 35-055 of Toray Silicone Co., Ltd.), 16% of a condutive carbon black (Ketjen Black® of Lion-Akzo Co., Ltd.), 0.5% of a chloroplatinic acid based crosslinking agent (SRX-212 of Toray Silicone Co., Ltd.) and 0.05% of an inhibitor (MR-23 of Toray Silicone Co., Ltd.).

The previously prepared reinforcing fiber bundle was dipped twice in the rubber paint and subsequently dried to form an elastomeric coating layer 1*c* on the fiber cord. A metallic resistive wire 1*d* made of a nickel-chromium alloy (wire diameter, 0.05 mm; electrical resistivity, 109 $\mu\Omega$/cm) was wound on the rubber-coated fiber bundle to form a conductor winding 1 having an outside diameter of about 0.7 mm and an electrical resistance of 16 k$\Omega$/m.

An EPDM (ethylene-propylene-diene terpolymer) having a dielectric constant of about 2.5 was extruded onto the conductor 1 to form an insulation coating on its surface. A glass fiber braid 3 was then formed around the EPDM insulation coating and a silicone rubber sheath 4 was formed around the braid by extrusion coating. As a result, a noise suppressing high tension resistive electrical wire having an outside diameter of about 5 mm was obtained.

The so fabricated winding of noise suppressing high tension resistive electrical wire according to the present invention was fine and supple enough to be easily bent and it yet had a smaller capacitance than nay conventional products.

We claim:

1. A winding of noise suppressing high tension resistive electrical wire comprising:

a reinforcing fiber cord bound by immersion in a low-viscosity liquid resin binder;

an elastomeric coating layer formed on a surface of said fiber cord by application of a liquid rubber paint;

a metallic resistive wire wound around said coating layer; and an insulating protective layer.

2. The winding of claim 1, wherein a thickness of said elastomeric coating layer is in the range of approximately 0.02 to 0.04 mm.

3. The winding of claim 1, wherein a diameter of said metallic resistive wire is in the range of 0.035 to 0.065 mm.

4. The winding of claim 3, wherein said metallic resistive wire is wound so as to be embedded into said coating layer.

5. The winding of claim 1, wherein an outside diameter of the winding is not greater than 7 mm.

6. The winding of claim 1, wherein said reinforcing fiber cord is made of glass fibers that are stranded at given pitches.

7. The winding of claim 1, wherein said reinforcing fiber cord is made of Aramid fibers stranded at given pitches.

8. The winding of claim 1, wherein said liquid resin binder is selected from the group essentially consisting of thermosetting resins, thermally crosslinking acrylic resins and styrene-butadiene resins.

* * * * *